US007644916B2

(12) United States Patent
Spatafora

(10) Patent No.: US 7,644,916 B2
(45) Date of Patent: Jan. 12, 2010

(54) UNIT AND A METHOD FOR FEEDING LABELS IN A PACKER MACHINE FOR TOBACCO PRODUCTS

(75) Inventor: Mario Spatafora, Granarolo (IT)

(73) Assignee: G.D S.p.A. (IT)

( * ) Notice: Subject to any disclaimer, the term of this patent is extended or adjusted under 35 U.S.C. 154(b) by 179 days.

(21) Appl. No.: 11/907,865

(22) Filed: Oct. 18, 2007

(65) Prior Publication Data

US 2008/0093791 A1 Apr. 24, 2008

(30) Foreign Application Priority Data

Oct. 18, 2006 (IT) ..... BO2006A0721

(51) Int. Cl.
*B65H 3/08* (2006.01)

(52) U.S. Cl. ..... 271/101; 271/99; 271/104

(58) Field of Classification Search ..... 271/99, 271/100, 101, 104, 161; 156/569, 570, 568, 156/566, 571
See application file for complete search history.

(56) References Cited

U.S. PATENT DOCUMENTS 4,349,186 A * 9/1982 Nakamura ..... 271/18
4,921,237 A * 5/1990 Nubson et al. ..... 271/11
5,472,184 A * 12/1995 Focke et al. ..... 271/11
5,941,681 A * 8/1999 Piotrowski et al. ..... 414/797.8
6,682,065 B2 * 1/2004 Leonarde et al. ..... 271/104
6,793,213 B2 * 9/2004 Ito et al. ..... 271/104

FOREIGN PATENT DOCUMENTS

| | | |
|---|---|---|
| DE | 24 36 354 | 2/1976 |
| DE | 89 06 446 U1 | 8/1989 |
| EP | 1 516 819 A | 3/2005 |
| FR | 2 692 874 A | 12/1993 |
| WO | WO 90/14274 | 11/1990 |

* cited by examiner

*Primary Examiner*—Kaitlin S Joerger
(74) *Attorney, Agent, or Firm*—Timothy J. Klima; Shuttleworth & Ingersoll, PLC

(57) ABSTRACT

A label feeder unit associated with a machine for packing tobacco products holds a stack of labels placed in a channel presenting an infeed end, and an outfeed end from which the labels are released to a take-up station, then picked up singly and transferred to a further unit of the machine. The outfeed end of the channel incorporates a transfer mechanism comprising a pair of contrarotating rollers placed on either side of the channel at a distance less than the width of the stack in such a way as to intercept the labels and transfer them to the take-up station, which is movable relative to the outfeed end of the channel under the pressure transmitted to the station by the labels taken up between the rollers. The transfer mechanism forms part of a feedback control loop by which the pressure registering through the labels at the take-up station is kept within prescribed limits.

25 Claims, 5 Drawing Sheets

UNIT AND A METHOD FOR FEEDING LABELS IN A PACKER MACHINE FOR TOBACCO PRODUCTS

BACKGROUND OF THE INVENTION

The present invention relates to a label feeder unit and to a method of feeding labels in a packer machine for tobacco products.

In particular, the invention finds application in the art field of devices for dispensing revenue stamps, coupons or tamper-evident seals, and of units for picking up and transferring such items to equipment by which they are affixed or applied to packets containing tobacco products.

In conventional machines for applying labels to packets containing tobacco products, the labels are fed to a pick-up and transfer unit by which they will be gummed and then affixed to the packets.

During the step of feeding the labels to the pick-up and transfer unit, the labels are arranged in one or more ordered stacks, each comprising a plurality of labels placed one on top of another. The labels therefore combine to form a single compact block.

Machines of prior art type for applying labels to packets of tobacco products are equipped with arms supporting the stack of labels, and serving also to establish a feed path along which the labels are advanced. The stack is subjected to a pushing force, directed toward the pick-up unit, so that the labels remain compacted together.

The pressure applied thus to the stack of labels can be generated by simple force of gravity, in the case of a vertical machine, or by push rods in the case of a horizontal machine; at all events, a force is directed through the stack, impinging ultimately on restraints afforded by the ends of the arms aforementioned and facing the pick-up unit.

The function of the restraints is to hold the labels in a predetermined position when taken up from the stack, in such a way as to facilitate the step by which the single labels are picked up.

It has been found, during the operation of conventional machines, that the step of picking up the labels can be problematic.

In effect, a degree of adhesion is created between the stacked labels, due mainly to the force applied at the top or rear of the stack to keep it compact, which works in opposition to the pick-up action.

The extent of the adhesion aforementioned is also difficult to predict, since the force applied to the stack of labels is dependent (especially in vertical machines) on the number of labels remaining in the stack as each successive pick-up is completed.

In addition, the force applied to the compacted labels induces an elastic deformation of the stack, in measure proportional to the number of labels making up the stack at any given moment.

Consequently, it happens in certain circumstances that no label will be picked up, or that two or more labels are picked up at once.

The drawback in question is betrayed particularly by label feeder units in cigarette packers of the latest generation, where labels must be taken from the stack and transferred at rates of up to a thousand per minute.

Accordingly, the object of the present invention is to provide a unit and a method for feeding labels in a packer machine for tobacco products, such as will be unaffected by the drawbacks mentioned above.

One object of the invention, in particular, is to provide a unit and a method for feeding labels in a packer machine for tobacco products, designed to allow a correct and systematic release of the single labels from the dispensing device to the pick-up and transfer unit.

A further object of the invention is to provide a unit and a method for feeding labels in a packer machine for tobacco products, by which labels can be transferred correctly in high numbers per unit of time.

SUMMARY OF THE INVENTION

The stated objects are realized according to the present invention in a unit for feeding labels in a packer machine for tobacco products, comprising a channel with an infeed end and an outfeed end, accommodating a stack of labels, a take-up station associated operationally with the outfeed end of the channel, from which the labels are taken up singly and transferred to a user machine, and means by which to transfer a succession of labels, operating between the outfeed end of the channel and the take-up station. The take-up station is movable relative to the outfeed end of the channel in response to the pressure exerted on the station by the succession of labels advanced by the transfer means, and the transfer means form part of feedback control means designed to ensure that the pressure exerted by the succession of labels on the take-up station can be kept within prescribed values.

The aforementioned objects are realized similarly in a method implemented by means of the unit disclosed, which includes the steps of loading a stack of labels into the unit, transferring the labels from the stack to a take-up station, then picking up the labels from the station and transferring them singly to a further machine unit. The method of the invention also includes the steps of measuring the pressure exerted on the take-up station by the transferred labels, and employing a feedback control loop to set the transfer rate of the labels on the basis of the measurement, in such a way as to maintain the pressure exerted on the take-up station within prescribed values.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
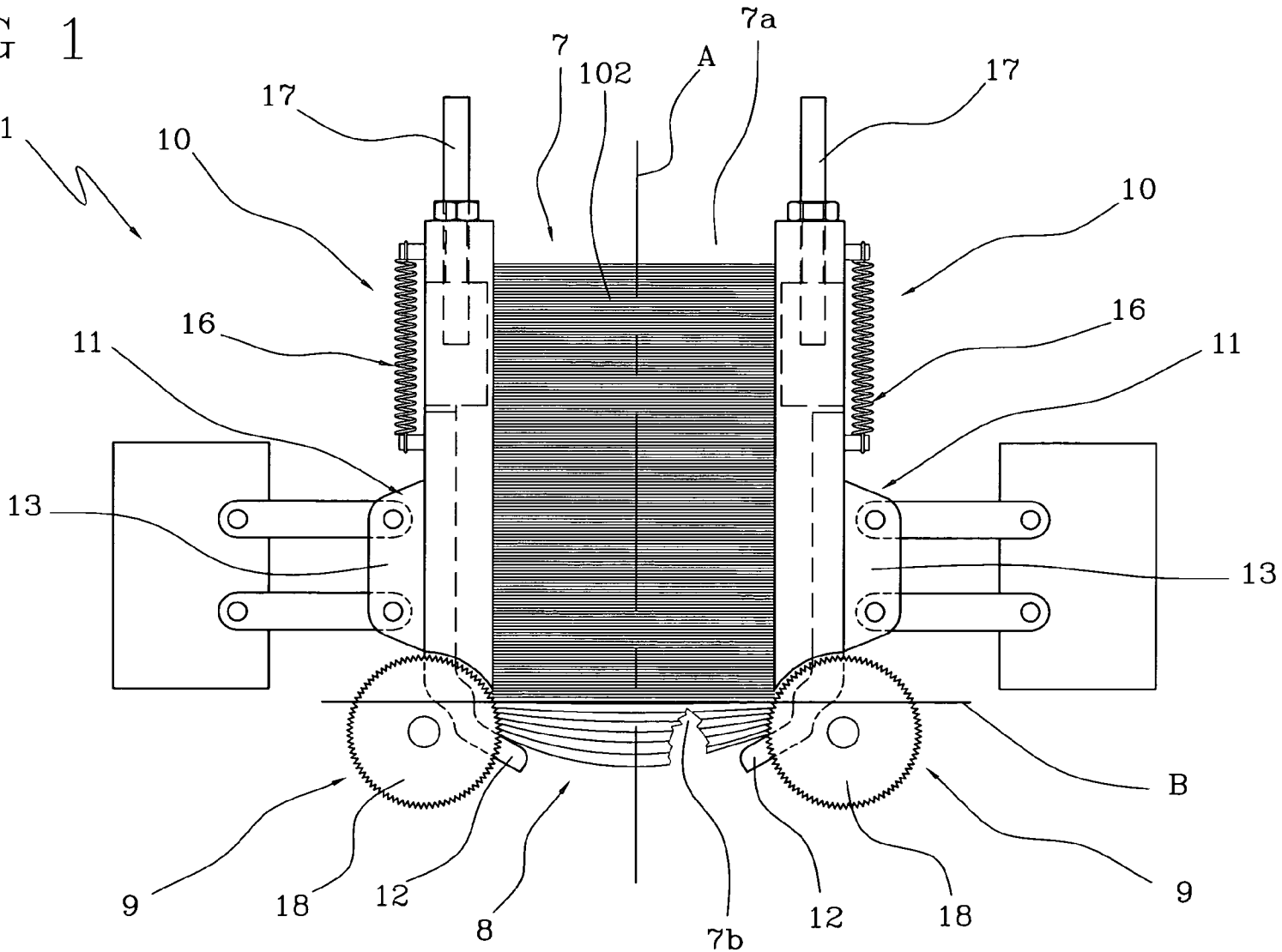
FIG. 1 shows a label feeder unit in a packer machine for tobacco products according to the present invention, illustrated in plan with certain parts omitted better to reveal others.

With reference to the drawings, numeral 1 denotes a label feeder unit, in its entirety, forming part of a packer machine for tobacco products. The single labels are denoted 100 in the drawings.

The term 'label', in the context of the present invention, can signify a revenue stamp, a coupon, a tamper-evident seal or other such slip typically of paper material, applicable for whatever purpose to packets containing tobacco products.

Figure 3:
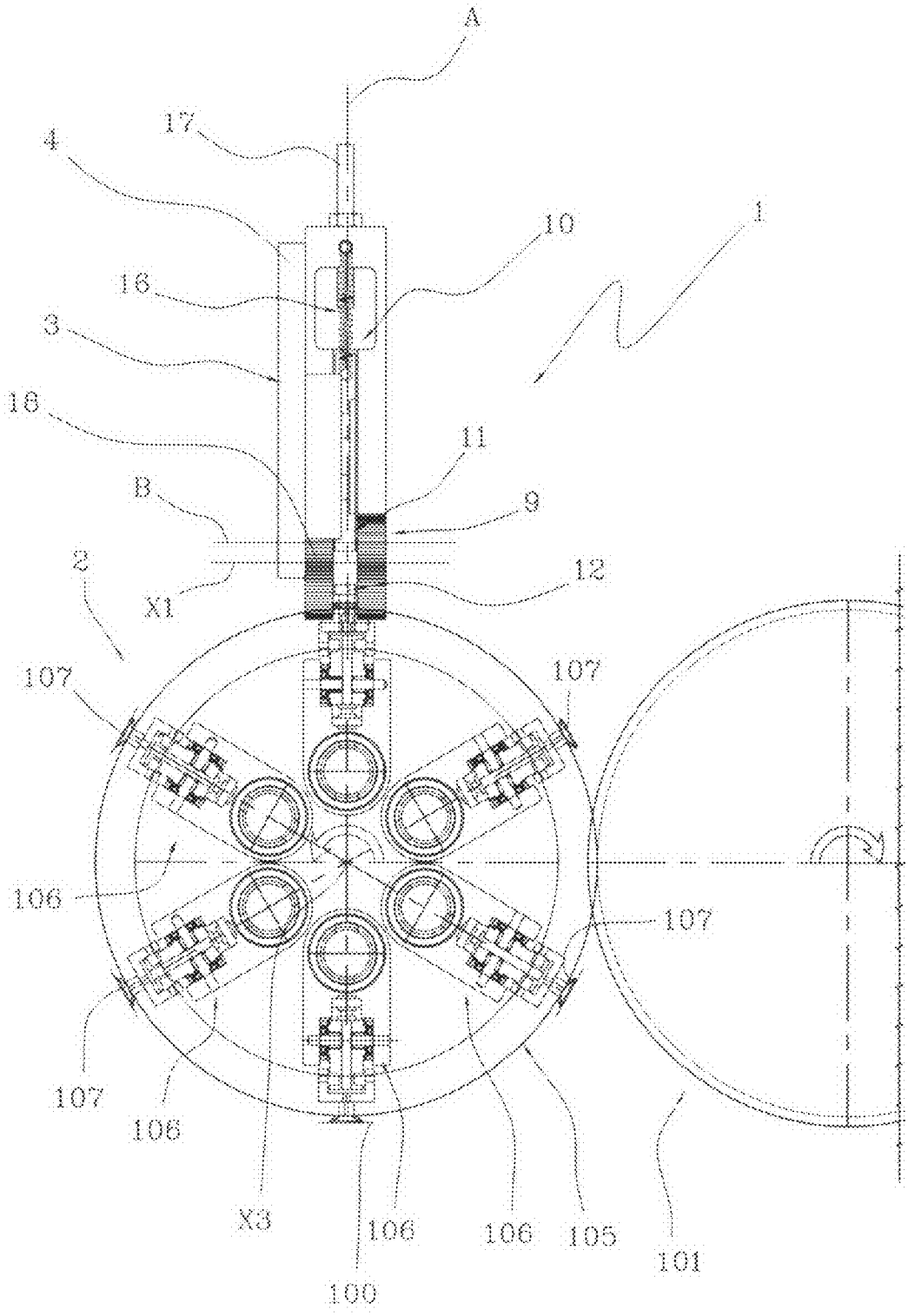
FIG. 3 is a side view of the label feeder unit according to the present invention.

As shown in FIG. 3, the unit 1 is associated operationally with pick-up and transfer means 2 by which labels 100 are conveyed singly and in ordered succession to user means denoted 101, schematized in FIG. 3 as a rotating drum 3.

The feeder unit 1 comprises means 3 by which to support a plurality of labels 100 placed one on top of another to form a stack 102.

The labels 100 are supplied to the unit 1 through the agency of a conventional mechanism not shown in the drawings, such as will direct a flow of the labels 100 to a first end of the stack 102.

In detail, the support means 3 comprise a plate 4 anchorable to a fixed structure employing means of conventional type (not illustrated), and two guide rails 5 stably associated with the plates 4.

The two guide rails 5 extend parallel one with another and function as respective flat walls 6. The two walls 6 and the portion of the plate 4 delimited by the guide rails 5 combine to create a channel 7 accommodating the stack 102 of labels 100, which presents an infeed end 7*a* facing the aforementioned supply mechanism, and an outfeed end 7*b*.

The width of the channel 7, that is to say the distance between the two walls 6, corresponds to one of the dimensions of a single label 100, so that the stack of labels can be housed in the channel 7 substantially to an exact fit.

In an alternative embodiment of the invention (not indicated), the guide rails 5 might be capable of movement toward and away from one another in such a way as to adapt the width of the channel 7 to the size of label 100 in use.

The labels 100 are arranged in the channel 7 such that each occupies a respective plane substantially perpendicular to the plate 4.

With the labels 100 subjected to a constant feed and pick-up action, the stack 102 is caused to pass continuously along the channel 7, and in particular along a direction coinciding with the longitudinal axis A of the stack 102.

To this end, the unit 1 comprises pushing means of conventional embodiment (not illustrated) located at the infeed 7*a* of the channel 7, such as will apply a pushing force to the stack 102, directed along the axis A of the selfsame stack 102 toward the outfeed end 7*b* of the channel 7.

Located beyond the outfeed 7*d* of the channel 7 is a station 8 at which the labels 100 are taken up by the pick-up and transfer means 2 in readiness for their release to the user means 101.

As illustrated in the accompanying drawings, the unit 1 further comprises transfer means 9 located between the outfeed 7*b* of the channel 7 and the take-up station 8, by which labels 100 are received in sequence one at a time from the bottom of the stack 102 and transferred to the take-up station 8.

The take-up station 8 is adjustable for position relative both to the outfeed 7*b* of the channel 7 and to the transfer means 9, according to the pressure exerted on the selfsame station 8 by the succession of labels 100 in the process of being transferred.

More exactly, the greater the number of labels 100 transferred per unit of time from the outfeed end 7*b* of the channel to the take-up station 8, the greater the pressure exerted by the labels 100 on the selfsame station 8 and consequently the greater the displacement of the station.

The unit 1 further comprises feedback control means 10 acting on the transfer means 9 in such a way as to ensure that the pressure exerted by the succession of labels 10 on the take-up station 8 is kept within prescribed values.

Thus, advantageously, the pressure that registers through the labels 100 occupying the take-up station remains substantially constant, favoring a correct release of the labels 100 to the pick-up and transfer means 2.

In effect, it has been verified by experiment that the labels 100 will be taken up correctly, one by one, avoiding the release of two or more single labels at a time, when the pressure acting on the labels at the outfeed end of the stack, and therefore at the take-up station 8, is maintained substantially constant and above a predetermined minimum threshold.

In addition, and to advantage, the action of the feedback control means 10 on the transfer means 9 serves also to ensure that the distance between the outfeed end 7*b* of the channel 7 and the take-up station 8 is kept likewise within prescribed values, thereby maximizing the efficiency of the pick-up and transfer means 2.

In practice, control over the distance between the take-up station 8 and the outfeed end 7*b* of the channel 7 is a function, indeed a consequence, of the control maintained over the pressure exerted by the labels 100 on the take-up station 8 given that it is this same pressure, as mentioned previously, that causes the take-up station 8 to move away from or toward the outfeed end 7*b* of the channel 7.

To advantage, therefore, when the pressure exerted on the take-up station 8 is maintained within prescribed values, the distance between this same station 8 and the outfeed end 7*b* of the channel 7 is kept likewise within prescribed values.

As discernible from FIG. 1, in particular, the transfer means 9 also function as detent means by which the feed motion of the stack 102 is checked at the outfeed end 7*b* of the channel 7.

In this situation, the pressure directed from the stack 102 toward the take-up station 8, generated by the force of the aforementioned pushing means, or of gravity in the case of a vertical unit 1, will not actually be transmitted to the take-up station 8.

Accordingly, the stack 102 retains its elasticity, and the pressure exerted on the take-up station 8 is not influenced by the number of labels 100 making up the stack, but dependent only on the number of labels 100 released per unit of time by the transfer means 9 to the take-up station 8.

In a preferred embodiment of the unit, the take-up station 8 comprises at least two abutment members denoted 11, each incorporating a restraint 12 presented by one end of a rod-like element 13.

The restraints 12 of the two abutment members 11 are mutually opposed and positioned to interact with the opposite edges of a label 103 at the moment of release, in such a way that the label is steadied and presented to the pick-up and transfer means 2.

The abutment members 11 are slidable independently of one another along an axis parallel to the axis A of the stack 102 of labels in response to the pressure exerted by the advancing labels 100 on the restraints 12.

Figure 2:
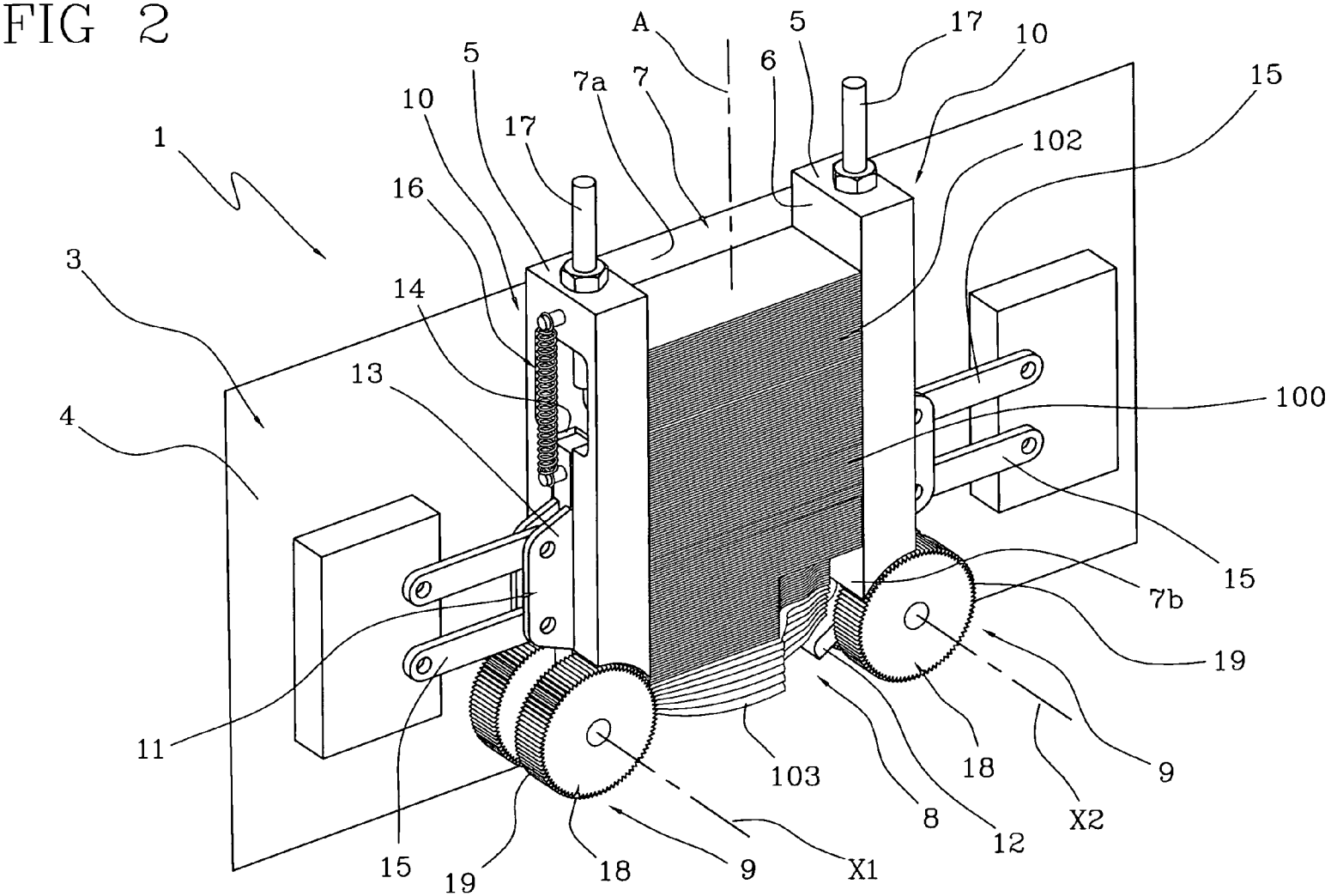
FIG. 2 is a perspective view of the unit in FIG. 1.

As illustrated in FIGS. 1 and 2, in particular, the rod-like elements 13 are slidable in grooves 15 afforded by the guide rails 5 of the channel 7, their translational motion guided by link rods 15 connecting the rod-like element 13 to the plate 4.

The feedback control means 10 comprise at least one traction element 16 schematized as a spring in FIGS. 1 and 2, which indicate two such springs, each operating between an abutment member 11 and a guide rail 5.

In particular, each of the traction elements 16 is connected at one end to one rod-like element 13 and at the opposite end to a portion of the guide rail 5 located upstream of the portion presenting the groove 14 in which the rod-like element 13 is slidable.

The traction elements 16 exert a predetermined force on the abutment members 11, generated in a direction opposite to the force exerted by the labels 100 on the restraints 12, in such a way that motion will be induced in the abutment members 11 when the pushing force on the restraints 12 is greater or less than the force exerted by the traction elements 16.

The movement of the abutment members 11 is also piloted by position sensors 17, illustrated in FIGS. 1 and 2, which form part of the feedback control means 10.

In the example of the accompanying drawings, the position sensors 17 are located internally of the guide rails 5 so as to measure the displacement of the rod-like elements 13; in practice, however, any other type of sensor might be used equally well to measure the displacement of the abutment members 11.

Whatever the type adopted, the position sensors 17 will be connected to a master control unit (not illustrated) which, in possession of data indicating the force exerted on the abutment members 11 by the traction elements 16, and of data indicating the displacement of the abutment members 11, is able to compute the pressure exerted at any given moment on the restraints 12 by the labels 100 passing through the transfer means 9.

Thus, the master control unit acts in feedback mode on the transfer means 9, raising or lowering the rate at which the labels 100 are released to the take-up station 8 according to the pressure acting on the restraints 12 at any given moment.

Importantly, to reiterate, the position of the restraints 12 will also be monitored continuously and kept within prescribed values.

In the example illustrated, the transfer means 9 include a first pair of rollers 18 mounted rotatably to the plate 4, each turning on a respective axis X1 and X2 normal to the plate 4 and thus orthogonal to the axis A of the stack 102 of labels.

The rollers 18 are placed at the outfeed end 7*b* of the channel 7 on opposite sides of the stack 102 and set in contrarotation by drive means, not shown in the drawings, so as to engage and transfer the labels from the stack 102 to the take-up station 8.

With this end in view, to ensure the labels 100 are taken up cleanly, the revolving surfaces of the rollers 18 present a knurled profile 19. The ridges of the knurled profile 19 extend along directions parallel to the axes X1 and X2 of rotation of the rollers 18, thus lying parallel to the respective edges of the labels 100 with which they engage.

The rollers 18 are set apart one from another by a distance less than the width of the stack 102, so as to intercept and advance the labels 100.

It will be seen therefore that the rollers 18 also provide the aforementioned detent means checking the feed motion of the stack 102.

In effect, the rollers 18 (when not in rotation, self-evidently) intercept the stack 102 and prevent the labels 100 from advancing, irrespective of the pressure exerted on the rollers 18 by the selfsame labels.

Accordingly, the pressure exerted via the stacked labels 100 on the rollers 18 is not transmitted to the abutment members 11 of the take-up station 8, bringing the advantages mentioned previously.

Figure 4:
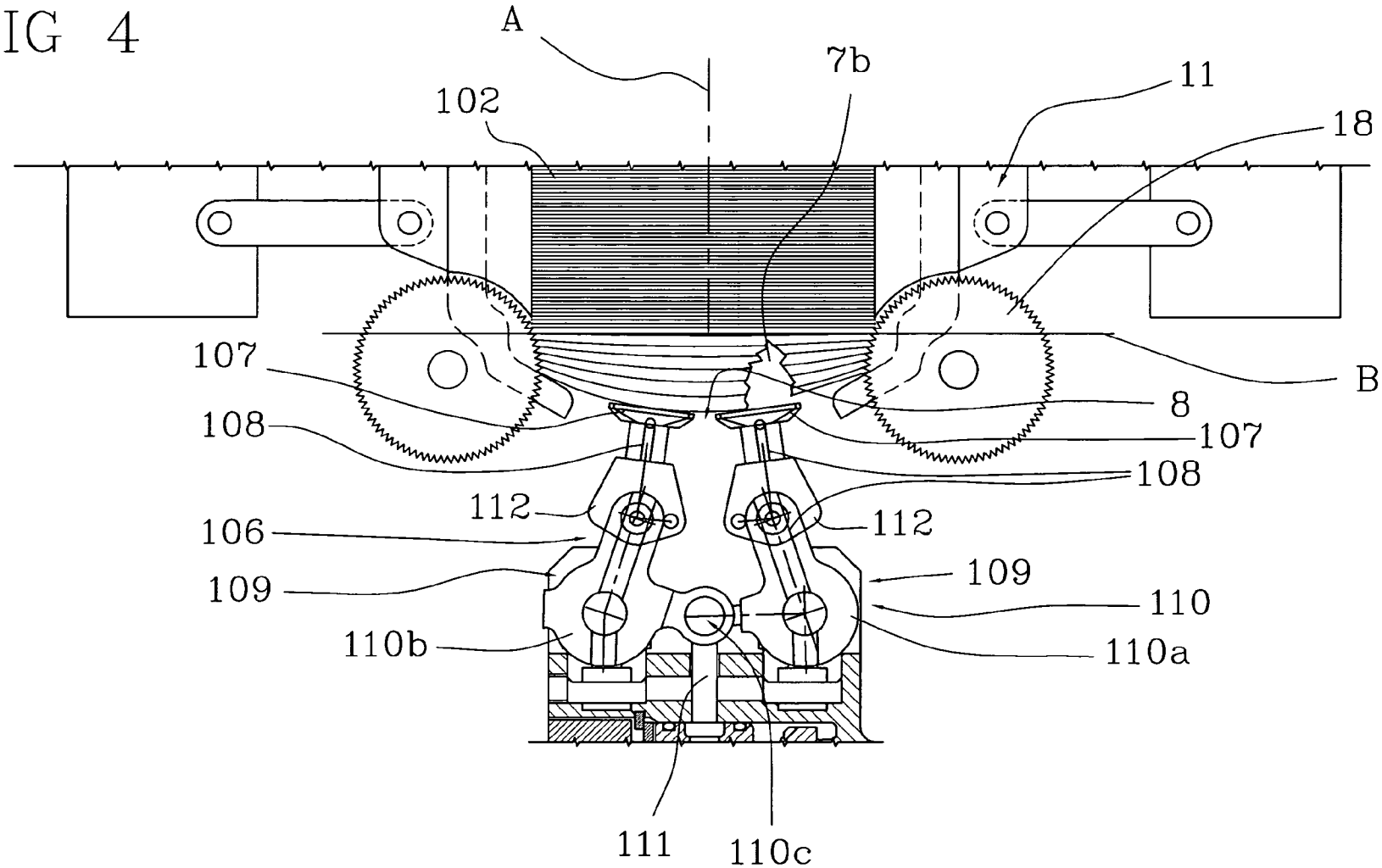
FIG. 4 is a sectional view showing a portion of the unit as in FIG. 3, illustrated in a first operating position.

The point at which the stack 102 of labels is intercepted by the rollers 18 coincides with a halt line B extending parallel to and upstream of the line joining the centers of the rollers 18, as illustrated in FIGS. 1 and 4.

Conversely, the restraints 12 coincide with a line of mutual alignment extending parallel to and below the line joining the centers of the rollers 18.

To advantage, with the abutment members 11 capable of movement independently of one another, as in the preferred embodiment described thus far, it becomes possible to identify and correct any transfer of the labels 100 which, though made at the correct rate, occurs with the labels not perfectly at right angles to the axis A of the stack 102.

In this situation, the pressures impinging on the two abutment members 11 would be dissimilar one to another, indicating that the labels 100 entering the take-up station 8 are skew relative to the correct transfer plane.

The master control unit corrects the misalignment by increasing or reducing the speed at which one of the two rollers 18 rotates, for a limited period, following which the labels 100 will realign and the pressure exerted on both abutment members 11 is equalized.

In an alternative embodiment, not illustrated, a further pair of rollers could be provided, flanking the rollers 18 of the first pair, and two further abutment members operating independently of one another, flanking the two abutment members 11 already described.

The four abutment members would interact with the four corners, or corner edges, of the labels.

With this arrangement, similarly, it will also be possible to correct a misalignment of the advancing labels 100 relative to a plane perpendicular to the plane described previously.

In other words, adopting a solution of this type, it will be possible to verify and ensure that the labels 100 advance exactly orthogonal to the axis A of the stack 102, or at all events aligned on any given plane.

The rollers 18 of the pair illustrated in the drawings combine to create a path converging along the transfer direction of the labels 100 toward the pick-up station 8, in such a way that the labels are deformed during the transfer step.

To advantage, the deformation of the transferred labels 100 is induced by bending each one relative to the plane occupied at the outfeed end 7*b*, thereby generating a concave face directed back toward the stack 102. Each deformed label 100 thus presents a bowed central portion of which the convex face is directed toward the pick-up and transfer means 2, as illustrated in the bottom part of FIGS. 1 and 2.

Accordingly, the restraints 12 are angled in such a way as to lie tangential to the bowed portion of the endmost label 103.

The aforementioned pick-up and transfer means 2 comprise a rotary conveyor 105 shown in FIG. 3, rotatable about an axis denoted X3, by which the single labels 103 are received from the take-up station 8 and conveyed to the aforementioned user means 101.

The pick-up and transfer means 2 comprise a plurality of gripping and retaining carriers 106 arranged around a peripheral surface of the rotary conveyor 105 and defining a feed path along which the successive endmost labels 103 of the stack are transported, retained by suction during the rotation of the conveyor 105.

Figure 5:
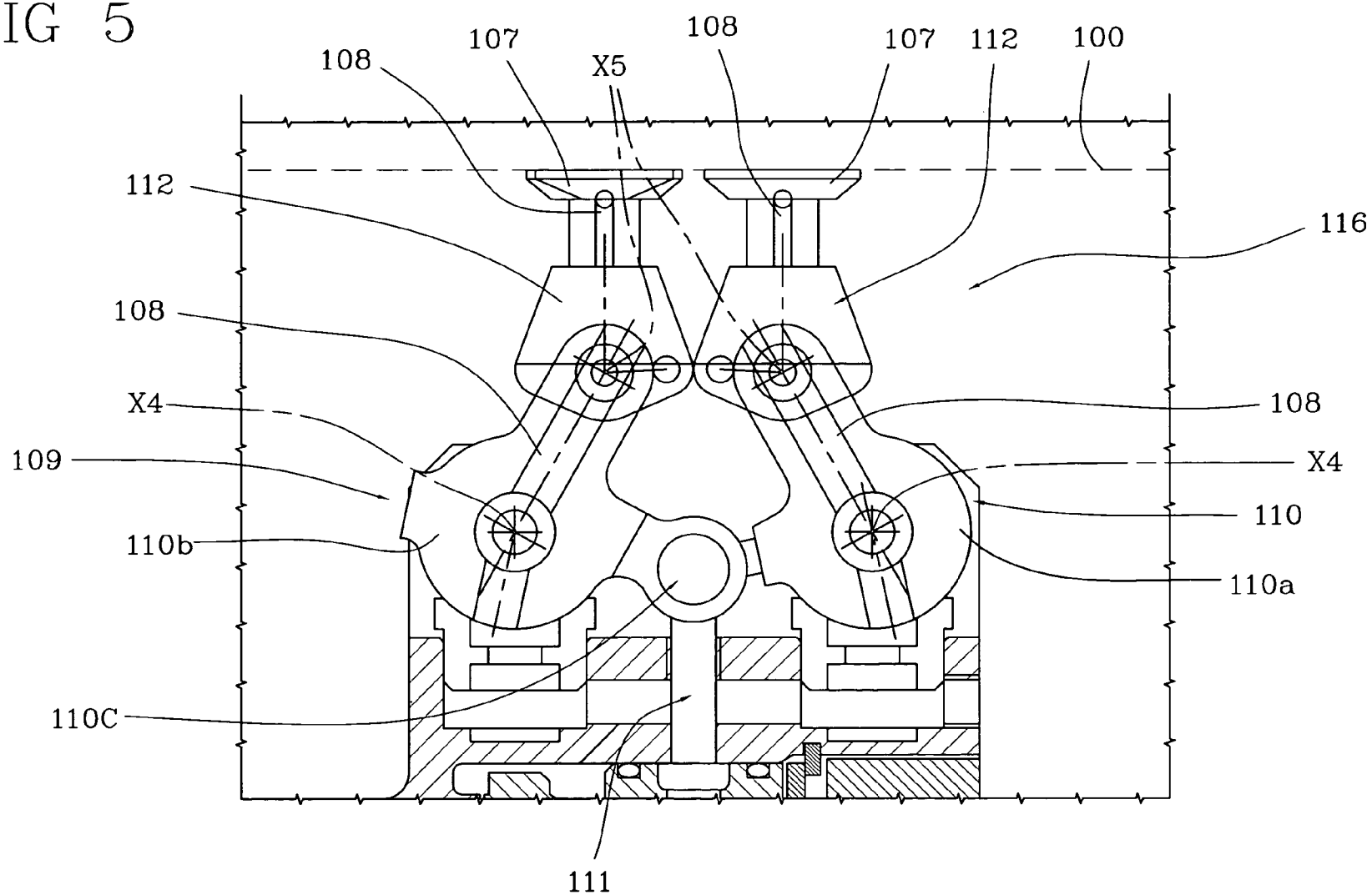
FIG. 5 is a sectional view showing the portion of FIG. 4, illustrated in a second operating position and with certain parts omitted better to reveal others.

As illustrated in detail in FIGS. 4 and 5, each gripping and retaining carrier 106 comprises a pair of suction cups 107 disposed side by side, thereby combining with the other carriers to form two rows of cups around the periphery.

The suction cups 107 of each pair can be offered simultaneously to the endmost single label 103 of the stack 102, which is thereupon taken up by vacuum force. To this end, each of the suction cups 107 is connected by way of a duct 108 to vacuum means of conventional type, not illustrated in the drawings.

Each carrier 106 also comprises motion-inducing means 109 that serve to guide the suction cups 107 between a plurality of pick-up positions in which the two cup rims occupy respective mutually inclined gripping planes, as illustrated in FIG. 4, and a release position in which the rims occupy a common plane, as illustrated in FIG. 5.

The motion-inducing means 109 present a pivotable mechanism 110 supporting the suction cups 107, of which the rocking motion defines the aforementioned pick-up position and release position of the suction cups 107.

The pivotable mechanism 110 incorporates a first arm 110*a* and a second arm 110*b*, each hinged to the peripheral surface of the rotary conveyor 105 about a respective pivot axis X4 and carrying a respective suction cup 107. The two arms 110*a* and 110*b* are interconnected by way of a translatable hinge 110*c* occupying an intermediate position between the two arms 110*a* and 110*b*, so that the selfsame arms can be contrarotated through an identical angle about the respective pivot axes X4, and the suction cups 107 made to assume the pick-up and release positions.

The motion-inducing means 109 further comprise a push-pull rod 111 linked to the two arms 110*a* and 110*b*, which acts on the hinge 110*c* in such a way as to rotate the arms 110*a* and 110*b* and thus cause the suction cups 107 to shift between the two operating positions.

The push-pull rod 111 is preferably reciprocated, capable of movement between a position retracted partly into the rotary conveyor 105, with the two arms 110*a* and 110*b* rotated in such a way as to bring the two suction cups 107 closer together, and an extended position with the two arms 110*a* and 110*b* rotated in such a manner as to spread the suction cups 107 farther apart. The rod 111 might be actuated electrically or pneumatically, by way of example.

The suction cups 107 are secured to respective clevis mounts 112, each attached pivotably to the respective arm 110*a* and 110*b* and rotatable thus about a relative axis X5. Anchored pivotably in this way, the suction cups 107 are able to assume the pick-up and release positions described above.

The position in which the rims of the two suction cups 107 occupy mutually inclined planes, or rather the pick-up position, coincides with the extended position of the push-pull rod 111 in which the two arms 110*a* and 110*b* are rotated and the associated suction cups 107 are spread apart, effectively to their maximum distance one from another. In this situation, the endmost label 103 of the stack 102 can be taken up smoothly and efficiently by the suction cups 107, which are configured in such a way as to adapt to the bowed surface of the label 103, as discernible in FIG. 4.

The release position of the suction cups 107 is assumed when the push-pull rod 111 occupies the retracted position, causing the arms 110*a* and 110*b* to rotate in such a way that the suction cups 107 are drawn together, effectively to their minimum distance one from another.

The objects stated at the outset are realized in accordance with the invention.

In effect, utilizing a feedback loop to monitor the pressure exerted by the labels on the take-up station and to control the rate at which the labels of the stack are released to this same station, the pressure exerted on the station can be maintained substantially constant, as also can the position of the station itself.

Thus, the best conditions possible are created for a swift and smooth transfer of the single labels.

What is claimed is:

1. A unit for feeding labels in a packer machine for tobacco products, comprising a channel presenting an infeed end and an outfeed end, in which to accommodate a stack of labels, a take-up station, associated operationally with the outfeed end of the channel, from which the labels are taken up singly and transferred to a user machine, and a mechanism by which to transfer a succession of labels, operating between the outfeed end of the channel and the take-up station, wherein the take-up station is capable of movement relative to the outfeed end of the channel in response to a pressure exerted on the take-up station through the succession of labels transferred by the transfer mechanism, and the transfer mechanism is interlocked to a feedback control in such a way that the pressure exerted by the succession of labels on the take-up station can be maintained within prescribed values, wherein the take-up station comprises at least two abutment members operating on opposite sides of a label at the take-up position and slidable along axes parallel to the longitudinal axis of the stack of labels in response to the pressure exerted by the labels on the transfer mechanism.

2. A unit as in claim 1, wherein the transfer mechanism is also interlocked to the feedback control in such a way that a distance between the take-up station and the outfeed end of the channel can be maintained within prescribed values.

3. A unit as in claim 1, wherein the transfer mechanism further comprises a detent mechanism by which the feed motion of the stack of labels can be checked at the outfeed end of the channel, in such a way that the pressure exerted by the stack of labels occupying the channel is not transmitted to the take-up station.

4. A unit as in claim 1, wherein feedback control incorporates at least one traction element exerting a predetermined force on the abutment members in the direction opposite to that of the force exerted on the abutment members by the labels, and at least one position sensor connected to a master control unit and serving to determine the position of the abutment members, in such a way that the pressure exerted on the abutment members can be detected by monitoring the position of the members.

5. A unit as in claim 4, wherein the master control unit operates on the transfer mechanism in such a way as to increase or reduce the rate at which the labels are transferred, in response to the pressure exerted by the labels on the abutment members.

6. A unit as in claim 1, wherein the transfer mechanism comprises at least one pair of rollers positioned at the outfeed end of the channel on opposite sides of the stack of labels, and set in contrarotation about respective axes orthogonal to the longitudinal axis of the stack in such a way as to engage the labels of the stack and transfer them to the take-up station.

7. A unit as in claim 6, wherein the rollers, functioning also as a detent mechanism, are set apart one from another at a distance less than the transverse dimension of the stack of labels, in such a way as to intercept and check the advance of the labels occupying the channel and thus prevent the pressure exerted by the stack from being transmitted to the take-up station.

8. A unit as in claim 6, wherein substantially convergent profiles of the rollers combine to create a path, extending from a position in which each label is engaged through a plurality of positions occupied by the advancing label, along which the single labels are caused to bend progressively and assume a bowed profile directed convexly toward the take-up station, with the result that each label is separated from the next in sequence.

9. A unit as in claim 1, wherein the take-up station comprises a third and a fourth abutment member distanced from and parallel with the at least two abutment members, slidable along axes parallel to the longitudinal axis of the stack of labels in response to the pressure exerted by the labels on the transfer mechanism, the four abutment members being thus positionable substantially at the four corners of the transferred labels in such a way as to sense the pressure registering at the corners and identify any skew misalignment of the transferred labels.

10. A unit as in claim 6, wherein the transfer mechanism comprises a second pair of contrarotating rollers distanced from and parallel with the at least one pair of rollers, and rotatable independently of these same rollers, in such a way that any skew misalignment of the transferred labels can be corrected by selectively increasing or reducing the speed of rotation of the single rollers.

11. A unit as in claim 6, wherein the revolving surface of each roller presents a knurled profile such as will engage and retain the edges of the labels during the transfer step.

12. A unit as in claim 1, comprising a pusher mechanism impinging on the stack of labels in such a manner as to direct the stack of labels forcibly toward the outlet end of the channel.

13. A unit as in claim 1, comprising a pick-up and transfer mechanism incorporating at least one gripping and retaining carrier capable of movement between a position of alignment with the take-up station and a position at which the labels are released to the user machine, and mounted to a rotary conveyor turning on an axis substantially perpendicular to the longitudinal axis of the stack of labels.

14. A unit as in claim 13, wherein each gripping and retaining carrier is equipped with a pair of suction cups connected to a vacuum mechanism and designed to Lake up one label.

15. A unit as in claim 14, wherein each pair of suction cups is connected to a pair of respective clevis mounts capable of movement between a position in which the suction cups are disposed with the rims occupying a common plane, and a plurality of positions in which the rims of the suction cups occupy mutually inclined gripping planes.

16. A method of feeding labels in a packer machine for tobacco products, wherein the labels are ordered in a stack, including the steps of transferring a succession of labels from the stack to a take-up station, picking up the labels singly from the station and transferring each in turn to a user machine, determining the pressure exerted on the take-up station by the transferred labels, and setting the transfer rate of the labels via feedback control on the basis of the determined pressure, in such a way that the pressure exerted on the take-up station remains within prescribed values, further comprising, during the transfer step, a deformation step in which the transferred labels are bent for generating a concave face directed back toward the stack.

17. A method as in claim 16, including the further steps of inhibiting transmission to the take-up station of pressure exerted by the stack, and allowing transmission to the take-up station only of pressure generated by the labels transferred from the stack.

18. A method as in claim 16, wherein the step of determining the pressure exerted on the take-up station is effected by rendering the take-up station capable of movement in response to the exerted pressure, and measuring the displacement of the station.

19. A method as in claim 18, wherein the step of setting the transfer rate of the labels via feedback control is effected by increasing or reducing the speed of rotation of contrarotating rollers, positioned on opposite sides of the stack of labels in such a way as to engage a succession of labels and transfer them to the take-up station.

20. A method as in claim 17, wherein the step of inhibiting the transmission of pressure from the stack to the take-up station is effected by setting the contrarotating rollers apart one from another at a distance less than the transverse dimension of the stack of labels, in such a way that the stack is intercepted and detented by the rollers.

21. A unit for feeding labels in a packer machine for tobacco products, comprising a channel presenting an infeed end and an outfeed end, in which to accommodate a stack of labels, a take-up station, associated operationally with the outfeed end of the channel, from which the labels are taken up singly and transferred to a user machine, and a mechanism by which to transfer a succession of labels, operating between the outfeed end of the channel and the take-up station, wherein the take-up station is capable of movement relative to the outfeed end of the channel in response to a pressure exerted on the take-up station through the succession of labels transferred by the transfer mechanism, and the transfer mechanism is interlocked to a feedback control in such a way that the pressure exerted by the succession of labels on the take-up station can be maintained within prescribed values, wherein the transfer mechanism comprises at least one pair of rollers positioned at the outfeed end of the channel on opposite sides of the stack of labels, and set in contrarotation about respective axes orthogonal to the longitudinal axis of the stack in such a way as to engage the labels of the stack and transfer them to the take-up station, and wherein substantially convergent profiles of the rollers combine to create a path, extending from a position in which each label is engaged through a plurality of positions occupied by the advancing label, along which the single labels are caused to bend progressively and assume a bowed profile directed convexly toward the take-up station, with the result that each label is separated from the next in sequence.

22. A unit for feeding labels in a packer machine for tobacco products, comprising a channel presenting an infeed end and an outfeed end, in which to accommodate a stack of labels, a take-up station, associated operationally with the outfeed end of the channel, from which the labels are taken up singly and transferred to a user machine, and a mechanism by which to transfer a succession of labels, operating between the outfeed end of the channel and the take-up station, wherein the take-up station is capable of movement relative to the outfeed end of the channel in response to a pressure exerted on the take-up station through the succession of labels transferred by the transfer mechanism, and the transfer mechanism is interlocked to a feedback control in such a way that the pressure exerted by the succession of labels on the take-up station can be maintained within prescribed values, wherein the transfer mechanism comprises at least one pair of rollers positioned at the outfeed end of the channel on opposite sides of the stack of labels, and set in contrarotation about respective axes orthogonal to the longitudinal axis of the stack in such a way as to engage the labels of the stack and transfer them to the take-up station, and wherein the transfer mechanism comprises a second pair of contrarotating rollers distanced from and parallel with the at least one pair of rollers, and rotatable independently of these same rollers, in such a way that any skew misalignment of the transferred labels can be corrected by selectively increasing or reducing the speed of rotation of the single rollers.

23. A unit for feeding labels in a packer machine for tobacco products, comprising a channel presenting an infeed end and an outfeed end, in which to accommodate a stack of labels, a take-up station, associated operationally with the outfeed end of the channel, from which the labels are taken up singly and transferred to a user machine, and a mechanism by which to transfer a succession of labels, operating between the outfeed end of the channel and the take-up station, wherein the take-up station is capable of movement relative to the outfeed end of the channel in response to a pressure exerted on the take-up station through the succession of labels transferred by the transfer mechanism, and the transfer mechanism is interlocked to a feedback control in such a way that the pressure exerted by the succession of labels on the take-up station can be maintained within prescribed values, wherein the transfer mechanism comprises at least one pair of rollers positioned at the outfeed end of the channel on opposite sides of the stack of labels, and set in contrarotation about respective axes orthogonal to the longitudinal axis of the stack in such a way as to engage the labels of the stack and transfer them to the take-up station, and wherein the revolving surface of each roller presents a knurled profile such as will engage and retain the edges of the labels during the transfer step.

24. A unit for feeding labels in a packer machine for tobacco products, comprising a channel presenting an infeed end and an outfeed end, in which to accommodate a stack of labels, a take-up station, associated operationally with the outfeed end of the channel, from which the labels are taken up singly and transferred to a user machine, and a mechanism by which to transfer a succession of labels, operating between the outfeed end of the channel and the take-up station, wherein the take-up station is capable of movement relative to the outfeed end of the channel in response to a pressure exerted on the take-up station through the succession of labels transferred by the transfer mechanism, and the transfer mechanism is interlocked to a feedback control in such a way that the pressure exerted by the succession of labels on the take-up station can be maintained within prescribed values, wherein the unit further comprises a pick-up and transfer mechanism incorporating at least one gripping and retaining carrier capable of movement between a position of alignment with the take-up station and a position at which the labels are released to the user machine, and mounted to a rotary conveyor turning on an axis substantially perpendicular to the longitudinal axis of the stack of labels, wherein each gripping and retaining carrier is equipped with a pair of suction cups connected to a vacuum mechanism and designed to take up one label and wherein each pair of suction cups is connected to a pair of respective clevis mounts capable of movement between a position in which the suction cups are disposed with the rims occupying a common plane, and a plurality of positions in which the rims of the suction cups occupy mutually inclined gripping planes.

25. A method of feeding labels in a packer machine for tobacco products, wherein the labels are ordered in a stack, including the steps of transferring a succession of labels from the stack to a take-up station, picking up the labels singly from the station and transferring each in turn to a user machine, determining the pressure exerted on the take-up station by the transferred labels, and setting the transfer rate of the labels via feedback control on the basis of the determined pressure, in such a way that the pressure exerted on the take-up station remains within prescribed values, further including the steps of inhibiting transmission to the take-up station of pressure exerted by the stack and allowing transmission to the take-up station only of pressure generated by the labels transferred from the stack, wherein the step of setting the transfer rate of the labels via feedback control is effected by increasing or reducing the speed of rotation of contrarotating rollers, positioned on opposite sides of the stack of labels in such a way as to engage a succession of labels and transfer them to the take-up station, and wherein the step of inhibiting the transmission of pressure from the stack to the take-up station is effected by setting the contrarotating rollers apart one from another at a distance less than the transverse dimension of the stack of labels, in such a way that the stack is intercepted and detented by the rollers.

* * * * *